US008789328B2

(12) United States Patent
Selph et al.

(10) Patent No.: US 8,789,328 B2
(45) Date of Patent: Jul. 29, 2014

(54) WALL PANEL AND BUILDING SYSTEM

(71) Applicant: Priton, LLC, West Conshohocken, PA (US)

(72) Inventors: Jeffrey Leaman Selph, Cary, NC (US); Clarence G. Crawford, Jr., Franklin, IN (US); Michael Lee Hosey, Angier, NC (US)

(73) Assignee: Priton, LLC, West Conshohocken, PA (US)

( * ) Notice: Subject to any disclaimer, the term of this patent is extended or adjusted under 35 U.S.C. 154(b) by 0 days.

(21) Appl. No.: 13/798,649

(22) Filed: Mar. 13, 2013

(65) Prior Publication Data

US 2014/0182224 A1 Jul. 3, 2014

Related U.S. Application Data

(60) Provisional application No. 61/747,637, filed on Dec. 31, 2012.

(51) Int. Cl.

| | |
|---|---|
| ***E04C 1/40*** | (2006.01) |
| ***E04C 2/04*** | (2006.01) |
| ***E04C 2/38*** | (2006.01) |
| ***E04C 2/20*** | (2006.01) |

(52) U.S. Cl.

CPC . *E04C 2/38* (2013.01); *E04C 2/044* (2013.01); *E04C 2/205* (2013.01)

USPC ..... 52/309.12; 52/293.3; 52/309.14; 52/309.17

(58) Field of Classification Search

CPC ..... E04B 2001/2684; E04B 2/04

USPC ..... 52/309.12, 309.14, 309.17, 782.1, 52/783.1, 293.3, 295, 284, 223.1, 90.1, 52/93.1, 474, 483.1

See application file for complete search history.

(56) References Cited

U.S. PATENT DOCUMENTS

| | | | |
|---|---|---|---|
| 4,454,702 | A | 6/1984 | Bonilla-Lugo |
| 5,119,606 | A | 6/1992 | Graham |

(Continued)

OTHER PUBLICATIONS

Wagh, Arun, Ceramicrete/Grancrete—Magnesium Dihydrogen Phosphate binder, www.rexresearch.com/wagh/wagh.htm, accessed Jan. 21, 2013, 71 pgs.

(Continued)

*Primary Examiner* — Jeanette E Chapman
*Assistant Examiner* — James Buckle, Jr.
(74) *Attorney, Agent, or Firm* — Matthew W. Witsil; Moore & Van Allen PLLC

(57) ABSTRACT

A composite, prefabricated panel for building construction. A panel includes a central core having a first face and a second face. The central core includes structural framing members assembled to define at least one opening. A substantially rigid insulation is disposed in the at least one opening of the structural framing members. A settable cement, which may be, for example, phosphate ceramic, is provided on each of the first face of the central core and the second face of the central core to form a first face of the panel and a second face of the panel. The insulation may define a plurality of passages, each with phosphate ceramic extending through the passage between and being monolithic with the phosphate ceramic on the first face of the central core and the phosphate ceramic on the second face of the central core. A building system with such panels is provided.

27 Claims, 8 Drawing Sheets

(56) References Cited

U.S. PATENT DOCUMENTS

| | | | | |
|---|---|---|---|---|
| 5,335,472 | A * | 8/1994 | Phillips | 52/742.14 |
| 5,515,659 | A * | 5/1996 | MacDonald et al. | 52/474 |
| 5,522,194 | A * | 6/1996 | Graulich | 52/309.4 |
| 5,645,518 | A | 7/1997 | Wagh et al. | |
| 5,830,815 | A | 11/1998 | Wagh et al. | |
| 5,846,894 | A | 12/1998 | Singh et al. | |
| 5,927,032 | A * | 7/1999 | Record | 52/309.11 |
| 6,047,503 | A * | 4/2000 | Kost | 52/79.9 |
| 6,133,498 | A | 10/2000 | Singh et al. | |
| 6,153,809 | A | 11/2000 | Singh et al. | |
| 6,204,214 | B1 | 3/2001 | Singh et al. | |
| 6,418,686 | B1 * | 7/2002 | Record | 52/309.15 |
| 6,518,212 | B1 | 2/2003 | Wagh et al. | |
| 6,776,837 | B2 | 8/2004 | Wagh et al. | |
| 7,001,860 | B2 | 2/2006 | Wagh et al. | |
| 7,107,731 | B2 * | 9/2006 | Record | 52/309.9 |
| 7,395,999 | B2 * | 7/2008 | Walpole | 249/33 |
| 7,709,091 | B2 * | 5/2010 | Villani et al. | 428/422 |
| 2005/0188649 | A1 * | 9/2005 | Hagen | 52/782.1 |
| 2005/0204697 | A1 * | 9/2005 | Rue | 52/782.1 |
| 2005/0274290 | A1 | 12/2005 | Wagh et al. | |
| 2006/0265985 | A1 | 11/2006 | Nichols | |
| 2007/0062151 | A1 * | 3/2007 | Smith | 52/782.1 |
| 2008/0251198 | A1 | 10/2008 | Tinianov | |
| 2009/0313926 | A1 * | 12/2009 | Schwartau | 52/274 |
| 2011/0120049 | A1 * | 5/2011 | Leo | 52/782.1 |
| 2012/0247043 | A1 | 10/2012 | McDonald | |

OTHER PUBLICATIONS

Korean Intellectual Property Office, International Application No. PCT/US2013/078473 International Search Report and Written Opinion dated Apr. 15, 2014, pp. 1-20.

* cited by examiner

WALL PANEL AND BUILDING SYSTEM

CROSS-REFERENCE TO RELATED APPLICATIONS

This application claims the benefit of U.S. Provisional Application No. 61/747,637, filed Dec. 31, 2012, the entire contents of which are incorporated herein by reference.

FIELD

Aspects of the present disclosure relate to panels and structures constructed therefrom, and more particularly to composite material panels that may be assembled to form building walls.

BACKGROUND

Prefabricated wall panels are commonly made of reinforced Portland cement concrete, and have certain advantages that include being part of a system ready to be assembled, with each part designed for a designated position, and the benefits of being made in the controlled environment of a factory, where tolerances may be kept to a minimum. Such wall panels, however, present certain difficulties in transportation and construction because of their weight, which may require special measures to be taken for transport and may result in loading trucks below their volume capacity. Weight limitations may result in a seemingly excessive number of shipments being made to complete an order for a building, whereas a reduced number of shipments could be made if the panels were lighter. Shipments as cargo on ships may also be expensive because of the weight. A crane or other mechanical lifting apparatus may be required to lift the panels.

In addition, wall panels generally must meet requirements for strength under building codes and national standards. Due to efforts to reduce weight, such panels may sacrifice strength, both axially as may be experienced from roof loads, and laterally as may be experienced from wind loads.

SUMMARY

In accordance with an embodiment disclosed herein, a panel includes a central core having a first face and a second face. The central core includes structural framing members assembled to form a perimeter and to define at least one opening. A substantially rigid insulation is disposed in the at least one opening of the structural framing members. A phosphate ceramic layer is provided on each of the first face of the central core and the second face of the central core to form a first face of the panel and a second face of the panel. In some embodiments, the structural framing members comprise light gauge metal or metal alloy, such as light gauge steel framing members.

In some embodiments and as may be included in any of the preceding embodiments, the insulation is expanded polystyrene and/or fiberglass, the phosphate ceramic is magnesium-based and may further include calcium silicate, there is a fire resistant ceramic-based coating on the first and/or the second faces of the panel, or any combination thereof. The phosphate ceramic and the ceramic-based coating may each further include one or more of alkali silicate, alkali metal, alkali earth metal, fly ash, slag, crushed glass, and silica, and the ceramic-based coating may further include colorant. In some embodiments and as may be included in any of the preceding embodiments, the insulation defines at least one passage, and phosphate ceramic extends through the passage between the phosphate ceramic layer on the first face of the central core and the phosphate ceramic layer on the second face of the central core. In some such embodiments, the at least one passage is a plurality of passages, each with phosphate ceramic extending through the passage between the phosphate ceramic on the first face of the central core and the phosphate ceramic on the second face of the central core. In some such embodiments, the phosphate ceramic extending through the passage is bonded or monolithic with the phosphate ceramic layer on the first face of the central core and the phosphate ceramic on the second face of the central core. In some embodiments and in combination with any of the above embodiments, the structural framing members comprise three spaced parallel studs, each stud having two ends, and two parallel tracks, with the tracks being perpendicular to the studs, wherein each end of each stud is attached to a track, and wherein the structural framing members form a rectangular perimeter and two rectangular openings.

In some embodiments, the axial load strength of a panel measuring 4 foot by 8 foot by 5 inches and tested in accordance with ASTM E72 is at least 30,000 pounds, and in some embodiments is 37,000 pounds. In some embodiments, the panel when tested in accordance with ASTM E72 withstands a flexure pressure as of at least 150 pounds per square foot prior to failure, and in some embodiments withstands a flexure pressure as of at least 199 pounds per square foot prior to failure. In some embodiments, a pair of assembled panels each measuring 4 foot by 8 foot by 5 inches and tested in accordance with ASTM E72 withstands a racking shear load of at least 1,200 pounds per linear foot prior to failure, and in some embodiments withstands a racking shear load of at least 1,575 pounds per linear foot prior to failure.

In accordance with another embodiment, a panel includes a central core. The central core has a first face and a second face and includes structural framing members assembled to form a perimeter and to define at least one opening therethrough, and a substantially rigid insulation. The substantially rigid insulation is disposed in the at least one opening of the structural framing members, and defines a plurality of passages that extend between the first face of the central core and the second face of the central core. A settable cement layer is positioned on each of the first face of the central core to form a first face of the panel and the second face to form a second face of the panel. Settable cement is disposed in the plurality of passages to extend between the first face of the panel and the second face of the panel. In some such embodiments, the settable cement of the settable cement layer and the settable cement disposed in the plurality of passages are each a phosphate ceramic. In some embodiments, the structural framing members are light gauge metal or metal alloy, such as light gauge steel. In some embodiments, the insulation includes expanded polystyrene or fiberglass material. In some embodiments and in combination with any of the above embodiments, the structural framing members comprise three spaced parallel studs, each stud having two ends, and two parallel tracks, with the tracks being perpendicular to the studs, wherein each end of each stud is attached to a track, and wherein the structural framing members form a rectangular perimeter and two rectangular openings.

In accordance with another embodiment, a building system is provided. The building system includes a foundation, a plurality of prefabricated panels, each panel having an upper end and a lower end and being mounted to the foundation at the lower end and to at least one other adjacent panel, and a roof structure. The panels each include a central core having a first face and a second face. The central core includes structural framing members assembled to form a perimeter and to define at least one opening. A substantially rigid insulation is disposed in the at least one opening of the structural framing members. A phosphate ceramic is provided on each of the first face of the central core and the second face of the central core to form a first face of the panel and a second face of the panel. The roof structure is mounted to the upper end of the panels.

In some embodiments of the building system, at a joint where adjacent panels abut, recesses in the sides of the panels form a tension rod opening. A tension rod is disposed in the tensioning rod opening and has a first end and a second end, the first end of the tension rod being anchored to the foundation, and the roof structure being mounted to the second end of the tension rod. In some embodiments, the panels are transported to a building construction site in a cargo container of a tractor-trailer. In some such embodiments, the panels for an entire building may be transported in the cargo container and cumulatively weigh less than 46,000 pounds. In some embodiments and in combination with any of the above embodiments, the structural framing members comprise three spaced parallel studs, each stud having two ends, and two parallel tracks, with the tracks being perpendicular to the studs, wherein each end of each stud is attached to a track, and wherein the structural framing members form a rectangular perimeter and two rectangular openings.

In accordance with another embodiment, a method of making a composite panel is provided. The method includes assembling structural members and rigid insulation to form a central core having a first face and a second face, providing passages through the rigid insulation. A first layer of settable phosphate ceramic composition is dispensed in a form having the shape of the outer limits of the panel and allowed to at least partially "set." Dispensing can include pouring, spraying, or a combination of both of a slurry or suspension of the settable phosphate ceramic composition discussed in further detail below. Setting can be at ambient temperatures, e.g., 40-120° F. for example. The central core is placed in the form over the first layer of at least partially set phosphate ceramic. Additional settable phosphate ceramic composition is poured to fill the voids between the structural members and the form, to fill the passages, and to provide a second layer of at least partially set phosphate ceramic on the second face of the core. In some embodiments and as may be included in any of the preceding embodiments, the insulation is expanded polystyrene and/or fiberglass, the phosphate ceramic is magnesium-based and may further include calcium silicate, there is a fire resistant ceramic-based coating on the first and/or the second faces of the panel, or any combination thereof. The phosphate ceramic and the ceramic-based coating may each further include one or more of alkali silicate, alkali metal, alkali earth metal, fly ash, slag, crushed glass, and silica, and the ceramic-based coating may further include colorant. In some embodiments and in combination with any of the above embodiments, assembling structural members and rigid insulation to form a central core comprises assembling the structural framing members from member comprising three spaced parallel studs, each stud having two ends, and two parallel tracks, with the tracks being perpendicular to the studs, wherein each end of each stud is attached to a track, and wherein the structural framing members form a rectangular perimeter and two rectangular openings.

In accordance with another embodiment, a method of constructing a building is provided. The method includes providing a foundation of the building and providing a plurality of prefabricated panels, each panel having an upper end, a lower end, two sides, and two faces. The panels each include a central core having a first face and a second face. The central core includes structural framing members assembled to form a perimeter and to define at least one opening. A substantially rigid insulation is disposed in the at least one opening of the structural framing members. A phosphate ceramic is provided on each of the first face of the central core and the second face of the central core to form a first face of the panel and a second face of the panel. The method further includes mounting the lower end of each panel to the foundation with one side of each panel abutting a side of another panel to form a wall. Each panel is attached to an adjacent panel at a vertical joint, and a roof structure is mounted to each panel. Some such embodiments further include providing a tension rod at each vertical joint, the tension rod having a first end and a second end. The first end is anchored to the foundation and the roof structure is mounted to the second end. In some embodiments and as may be included in any of the preceding embodiments, the insulation is expanded polystyrene and/or fiberglass, and the phosphate ceramic is magnesium-based and may further include calcium silicate. In some embodiments, the method may further include spray coating an atomizable, fire-resistant ceramic-based coating formulation on at least one of the first face and the second face of the plurality of prefabricated panels. The phosphate ceramic and the ceramic-based coating may each further include one or more of alkali silicate, alkali metal, alkali earth metal, fly ash, slag, crushed glass, and silica, and the ceramic-based coating may further include colorant. In some embodiments and in combination with any of the above embodiments, the structural framing members comprise three spaced parallel studs, each stud having two ends, and two parallel tracks, with the tracks being perpendicular to the studs, wherein each end of each stud is attached to a track, and wherein the structural framing members form a rectangular perimeter and two rectangular openings.

Other aspects and features of the present disclosure will become apparent to those ordinarily skilled in the art upon review of the following non-limiting detailed description of the disclosure in conjunction with the accompanying figures.

DESCRIPTION

Figure 1:
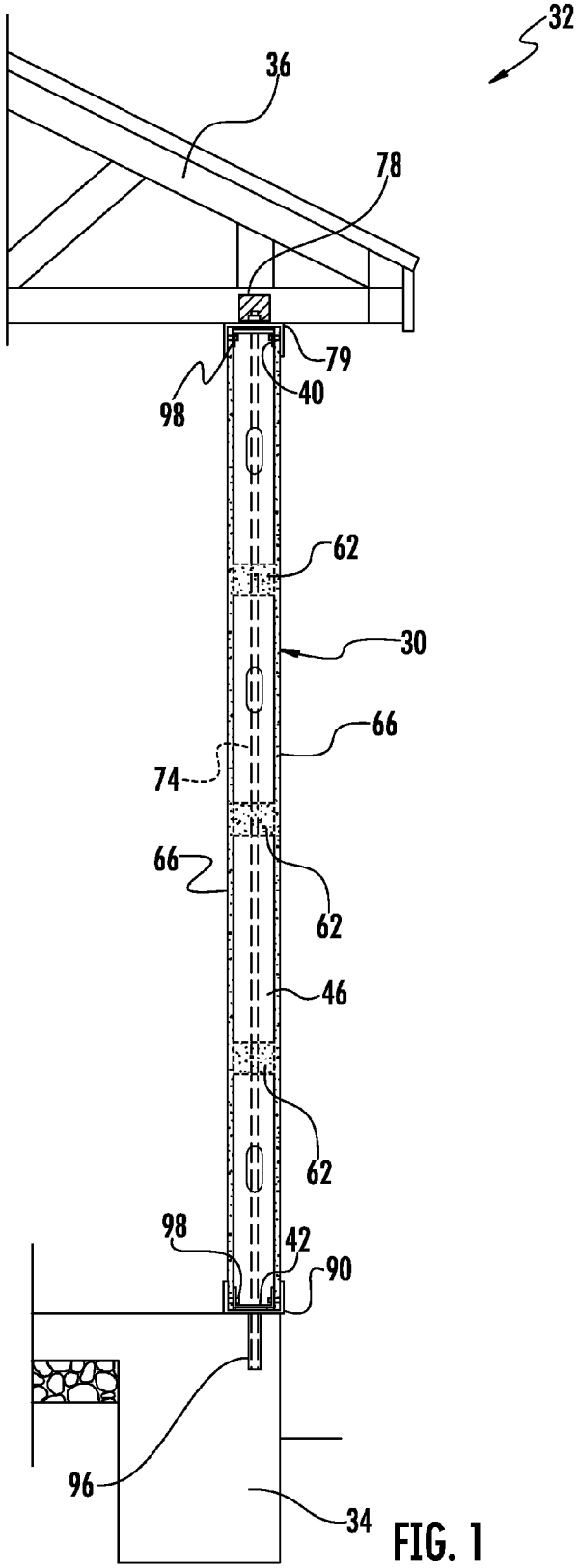
FIG. 1 is a side elevation view of a wall panel as part of a building in accordance with an embodiment of the present disclosure.

The following detailed description of embodiments refers to the accompanying drawings, which illustrate specific embodiments of the disclosure. Other embodiments having different structures and operations do not depart from the scope of the present disclosure. Like reference numerals may refer to the same element or component in the different drawings.

Certain terminology is used herein for convenience only and is not to be taken as a limitation on the embodiments described. For example, words such as "top," "bottom," "upper," "lower," "left," "right," "horizontal," "vertical," "upward," and "downward" merely describe the configuration shown in the figures or relative positions, or the orientation of a feature when components are in their installed positions. The referenced components may be oriented in any direction and the terminology, therefore, should be understood as encompassing such variations unless specified otherwise. Certain relative dimensions, sizes, and spacings are shown on the figures and discussed herein; it should be understood that the dimensions, sizes, and spacings shown and discussed merely illustrate selected embodiments. It should also be understood that throughout this disclosure, where a process or method is shown or described, the steps of the method may be performed in any order or simultaneously, unless it is clear from the context that one step depends on another being performed first.

FIGS. 1-4 show an embodiment of a composite wall panel, designated at 30. In FIG. 1, the wall panel 30 is installed a building 32, with may be a dwelling or other structure. The wall panel 30 may be mounted to a foundation 34, which may be, for example, conventional concrete, and a roof structure may be mounted to the wall panel 30. The roof structure may be, for example, a roof truss 36 that may be made of materials such as wood or light gauge roll formed steel. The wall panel 30 is a composite system that may include structural members, such as roll formed light gauge metal, such as light gauge steel framing members, and insulation.

Figure 2:
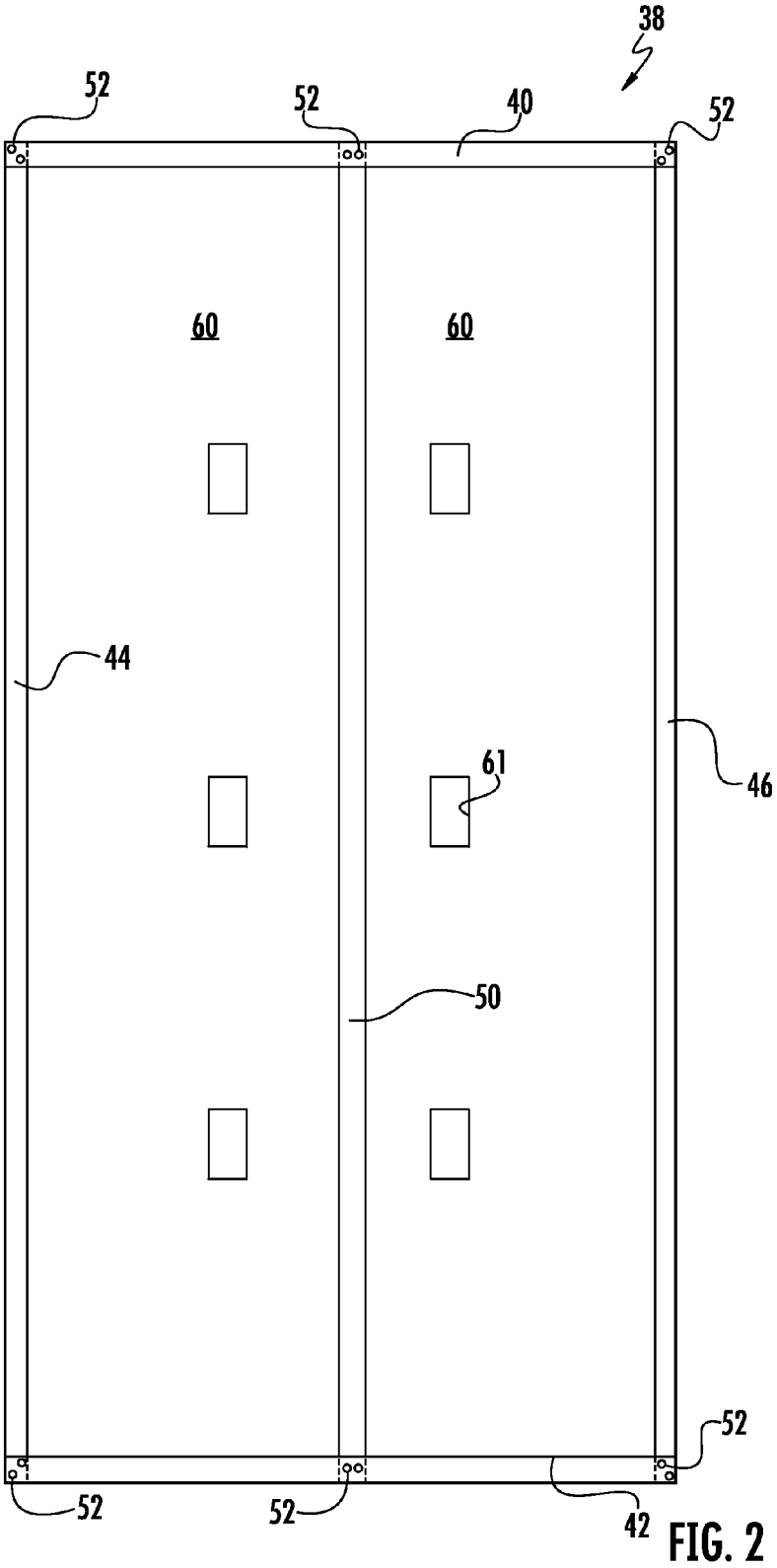
FIG. 2 is a front elevation view of selected components of the wall panel of FIG. 1.
Figure 3:
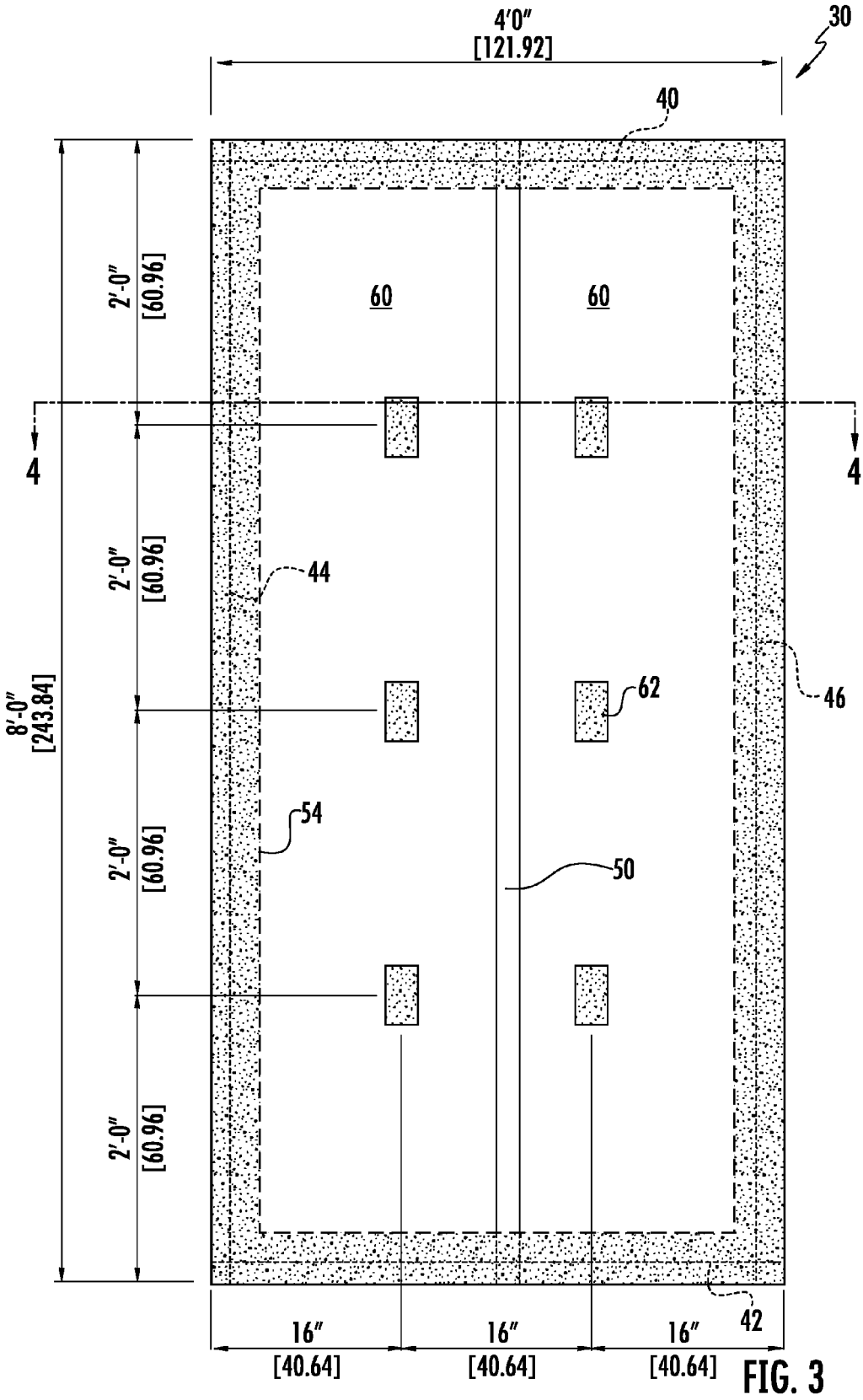
FIG. 3 is a partially exposed front elevation view of the wall panel of FIG. 1.
Figure 4:
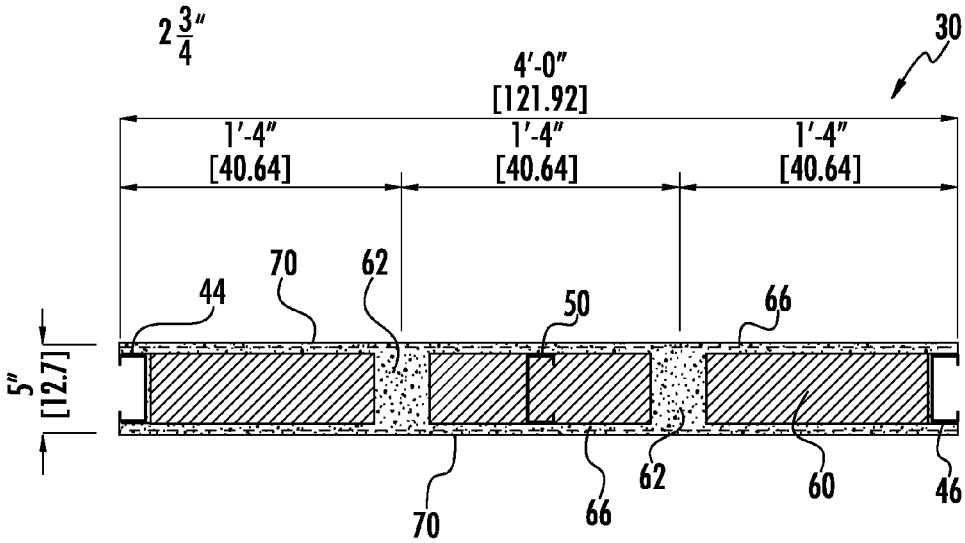
FIG. 4 is a section view of the wall panel of FIG. 1 taken along line 4-4 of FIG. 3.

FIG. 2 shows an embodiment of the core 38 of the wall panel 30 structural members of the wall panel 30 that may include a top track 40, a bottom track 42, a left side stud 44, right side stud 46, and a center stud 50. The flanges of the top track 40 face downward and the flanges of the bottom track 42 face upward such that the channels are open to receive the top and bottom ends, respectively, of the left side stud 44 and the right side stud 46, which will be vertical in the installed position. The center stud 50 may also be vertical and be centered between the left and right side studs 44, 46. The flanges of the left and right side studs 44, 46 extend outward from the center of the wall panel 30, and may be spaced from the sides of the wall panel 30. The studs 44, 46, 50 may be secured to the tracks 40, 42 with threaded fasteners such as high tensile strength screws 52.

The structural members 40, 42, 44, 46, 50 may form two elongated rectangular openings. Two or more pieces of rigid insulation 60 or other relatively light weight filler material may be placed in these openings. One piece of insulation 60 may be received in the channel of the center stud 50 on one side and another piece of insulation 60 abuts the web of the center stud 50 on the other side. The insulation 60 also may abut the webs of each of the left and right studs 44, 46, respectively. The insulation 60 may be deformed lengthwise along one edge to fit between the flange of the center stud 50 and to receive the returns of the center stud 50. The structural members 40, 42, 44, 46, 50 and insulation 60 may form the core 38 of the wall panel 30. There may be passages 61 extending through the insulation 60 across the core of the wall panel 30. The passages 61 may be filled with settable cement to form unions 62 between the faces of the panel 30. In the embodiment shown, there are six such settable cement unions 62. The side studs 44, 46 of a panel 30 may form an opening with adjacent panels when assembled to receive a tension rod, discussed further below.

As shown in the embodiment of FIGS. 1-4, the settable cement is a phosphate ceramic, which is discussed further below. While in some instances the settable cement is referred to herein as phosphate ceramic, it should be understood that the settable cement may be Portland cement, phosphate cement, or phosphate ceramic, for example, or other construction material that may be referred to by one of ordinary skill in the art as a cement, which may be dispensed and then sets to achieve strength.

On each face of the core 38, on the entire face, may be applied a settable cement layer 66 that may be, for example, less than 1-inch thick and may preferably be approximately ½-inch thick, and that may include embedded fiberglass mesh 70. At least a portion of the settable cement layer 66 covers the metal structural members 40, 42, 44, 46, and 50 and the insulation 60 to form a continuous surface across each face of the panel 30. FIG. 2 shows this layer 66 around the perimeter of the panel 30, with the area within dashed line 54 being shown with the ½-inch thick layer 66 removed for the purpose of illustration to expose part of the face of the core 38.

In the embodiment of FIGS. 1-4, the top and bottom track 40, 42 are shown as "U" shaped in cross-section, having a web and first and second flanges generally perpendicular to the web, without returns, while the studs 44, 46, 50 are shown as "C" shaped in cross-section, meaning having a web, first and second flanges generally perpendicular to the web, and returns on each flange. If such members are light gauge steel they may conform to ASTM C645, Standard Specification for Nonstructural Steel Framing Members and AISI S200, North American Standard for Cold-Formed Steel Framing. Instead a single stud, the center stud 50 may be a single member with an "I" cross-section. The metal structural members 40, 42, 44, 46, 50, if steel, may be galvanized, as may all steel used in the panels 30 and system. In the embodiment shown in FIGS. 1-4, all of the metal structural members 40, 42, 44, 46, 50 in the panel 30 may be 16 gauge, nominal 4-inch galvanized steel stud or track.

The rigid insulation may be expanded polystyrene (EPS) as in the embodiment of FIGS. 1-4, or in other embodiments fiberglass or extruded polystyrene and/or polyisocyanurate, and/or fiberglass mat or fiber, may be used. The EPS can be provided in one or more rigid forms that can be cut to size, layered, or otherwise arranged in the form, or the EPS (or equivalent) can be blown into the form. The insulation may be in some cases considered to be substantially rigid, in that while it may deflect or indent upon lateral loading, or may be deformed, it generally maintains its shape about one plane. Other relatively light weight materials that maintain their shape and can serve as a form for the settable cement unions 62 and settable cement layers 66 may be used, where the light weight material has a density less than that of settable cement. In the embodiment described above the thickness of the insulation may be 4 inches. The thickness of insulation 60 relative to that of the settable cement layer 66 can be chosen to minimize the total weight of the panel. Typically the weight of metal structural member is insignificant compared to the total weight of the panel as a result of the presently disclosed construction.

In the embodiment of FIGS. 1-4, the phosphate ceramic used for constructing the panel may provide a strength of from 4,000 to 6,000 psi. The fiberglass mesh 70 may be 8 to 12 oz. per square yard. The non-ceramic based components of the composite panel (metal, insulation) may be contacted, if desired, with one or more adhesives to facilitate or improve bonding or adhesion of the phosphate ceramic (pre-set composition or post-set), such as Ceramabond (two part magnesium oxide based adhesive, sold by Aremco Products, Inc.), but use of adhesives is not a requirement.

The overall dimensions of the embodiment of a panel 30 of FIGS. 1-4 may be 4 feet by 8 feet by 5 inches. Other size panels may also be provided; for example, larger panels may be desirable. The passages for unions 62 may in one embodiment, as shown, be arranged in two columns and three rows that are substantially evenly spaced both horizontally and vertically along the width and length of the panel 30, and the unions 62 may measure 3 inches by 5 inches.

In one method of fabricating a wall panel 30 in the embodiment described above, a jig may be used to assemble the structural members 40, 42, 44, 46, 50 with the insulation 60 placed in the openings to form the core. A form is provided with a bottom surface and upstanding side walls. The side walls may be shaped to provide the vertical notch 64 in the sides of the panels 30 as well and any other recessed areas that may be desired. Fiberglass mesh 70 may be placed on the bottom of the form, and a first phosphate ceramic layer 66 may be dispensed. The core may then be placed on that layer. Additional settable phosphate ceramic composition may then be dispensed to fill voids between the perimeter of the core and the upstanding side walls of the form and to fill the passages to make the unions 66, oriented in this position as columns. The dispense may continue to provide the second phosphate ceramic layer 66. The unions 62 may therefore be monolithic with the phosphate ceramic layers 66 on each face of the panel 30.

Figure 5:
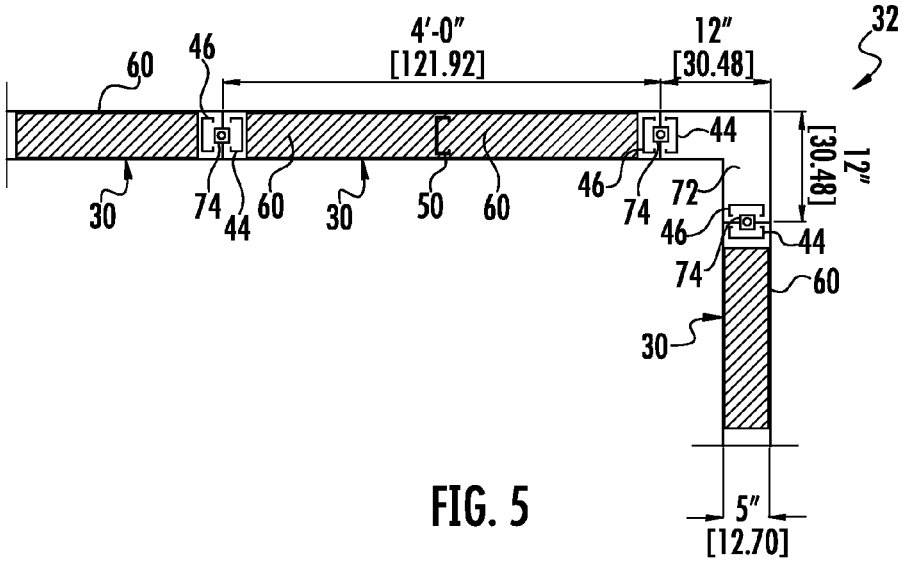
FIG. 5 is a schematic plan view of the layout of a portion of a building including the wall panel of FIG. 1.
Figure 6:
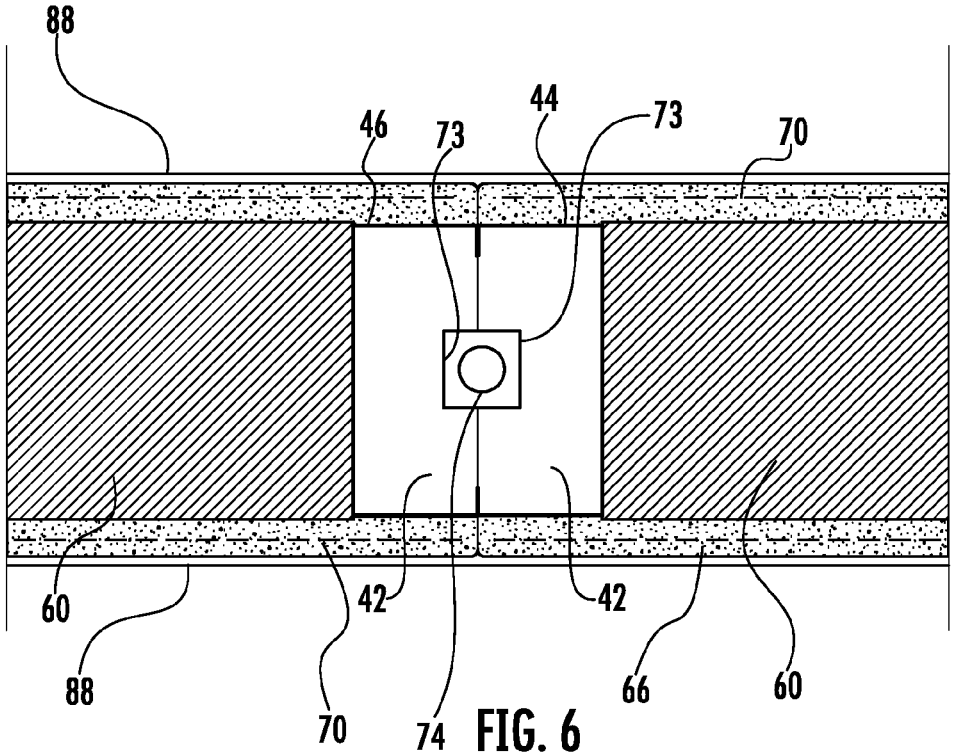
FIG. 6 is a detail view of a vertical joint between two wall panels of FIG. 1.

FIG. 5 shows a schematic plan view of a series of panels 30 assembled to form a wall, with a detail of a vertical joint shown in FIG. 6. A corner section 72 may be provided. The left side 44 of one panel 30 abuts the right side 46 of the adjacent panel 30, and the notches 73 that may be punched in the top track 40 and the bottom track 42 meet to form an opening that may receive a tension rod 74. The tension rod 74 may extend from the foundation 34 to the roof truss 36, and may be threaded. Tension rods 74 may be spaced, for example, at 48 inches (to be at the joints of the panels 30) on center and 12 inches from the corners. The tension rod 74 may be attached to the foundation 34 with an anchor that may be an expanding mechanical concrete anchor 76 (FIGS. 1 and 7), or alternatively adhesive anchors, both as may be manufactured by Hilti Corporation. At the upper end of the tension rod 74, a truss clip 78 may be used to mount the roof truss 36 to the tension rod 74 (FIG. 1) with at top channel 79, discussed below.

In some embodiments, proximate to the top and bottom of each panel 30 on each side and on each face indentations (not shown) in the phosphate ceramic may be provided. The indentations may receive a plate (also not shown) that spans the joint, and at each end of the plate the plate may be fastened to the studs 44, 46. For example, the indentations may be 3 inches wide by 2 inches tall, and when combined with the adjacent indentation may be 6 inches wide by 2 inches tall, which may be the dimension of the plate. The joint may be caulked on both sides, and both faces of the panel 30 may be coated with a ceramic-based coating 88.

In one embodiment, the tension rod 74 is a ¾-inch diameter, galvanized steel, all-thread rod that is anchored 2½ inches deep in the foundation concrete.

The settable phosphate ceramic composition can, by way of example, comprise an aqueous mixture of an acidic phosphate material and basic metal oxide or hydroxide. The settable phosphate ceramic composition can further comprise an effective amount of fire retardant material such as alkali or alkali earth silicates, fly ash, slag, or the equivalent. An effective amount of fire retardant material can be 5-75 weight percent to that of the basic metal oxide/hydroxide component. The settable phosphate ceramic composition can be provided in any form suitable for dispensing, such as pourable and/or sprayable slurries, suspensions, or dispersions. For example, the settable phosphate ceramic composition can comprise an aqueous mixture one or more of mono alkali phosphates or dihydrogen metal phosphates in combination with alkali/alkali earth metal oxides or hydroxides. For example, a monopotassium phosphate and magnesium oxide or hydroxide settable ceramic composition can be used. Other phosphates and/or oxides or hydroxides can be used.

In one embodiment, a dry mix particulate composition of a calcined oxide of Mg and/or Ca, an acid phosphate, and fly ash or equivalent, may be provided to yield a phosphate cement that may be sprayable and bond to the core 38, wherein the calcined oxide is present in the range of from about 17% to about 40% by weight and the acid phosphate is present in the range of from about 29% to about 52% by weight and the fly ash or equivalent is present in the range of from about 24% to about 39% by weight. When sand is added to the dry mix, it may be present in the range of from about 24% to about 47% by weight of the combined dry mix and sand. An aqueous slurry may be made where about 8-12 pounds of water is added to dry mix and sand.

Additional materials can be included in a ceramic-based coating 88, so as to retard setting (e.g., boric acid), to improve bonding or adhesion to the insulation, (e.g., polymers, for example, polyacrylates, polymethacrylates, and the like) (not needed or used in the embodiment of FIGS. 1-4), or to improve the rheological properties of the ceramic-based coating for dispensing (e.g., spraying, pouring, or painting aids), or to prevent mold or algae growth agents (e.g., copper oxide). The settable phosphate ceramic composition can further comprise colorants or other particulate material to impart color or texture to the surface thereof. In one aspect of the present disclosure, the settable phosphate ceramic is substantially absent the additional components described above so as to maximize one or more of the mechanical properties of the composite panel. In other aspects, additional material is added that improves the one or more of the mechanical properties of the composite panel.

The panel may, optionally, further comprise a ceramic-based coating 88 dispensed on one or more of the set phosphate ceramic surfaces of the composite panel, either when fabricating a panel or after installation of a panel. The ceramic-based coating may be a magnesium-based ceramic with one or more additional components to afford fire resistance and/or mold resistance. By way of example, the ceramic-based coating can be a settable metal phosphate composition, typically comprising a mixture of an acidic phosphate material and basic metal oxide or hydroxide, such as described above for the settable phosphate ceramic composition, but with an effective amount of fire retardant material such as alkali or alkali earth silicates, fly ash, or the equivalent. An effective amount of fire retardant material can be 5-75 weight percent to that of the basic metal oxide/hydroxide component. In this manner, the set phosphate ceramic of the panel can be, in one example, devoid of fire retardant material, so as to optimized its strength, whereas the ceramic-based coating composition can provide the majority of the fire resistance. This arrangement provides for cost reduction and manufacturing efficiency. Thus, in one aspect, the settable phosphate ceramic of the composite panel is substantially free of filler and/or additional components such as fire retardant materials such as fly ash, or particulates and/or colorants, whereas the ceramic-based coating composition comprises an effective amount of fire retardant materials such as fly ash, or particulates and/or colorants.

Exemplary ceramic-based coatings, preferably include atomizable suspensions or dispersions of one or more of mono alkali phosphates or dihydrogen metal phosphates in combination with alkali/alkali earth metal oxides or hydroxides so that they are dispensed like paints or other thin, low-rebound, adhering coatings. Additional materials can be included in the ceramic-based coating, so as to improve bonding or adhesion to the set phosphate ceramic surface of the panel, and/or the metal and/or insulation, such as polymers, for example, polyacrylates, polymethacrylates, and the like, or may contain agents to improve the rheological properties of the ceramic-based coating composition for dispensing (e.g., spraying or painting aids). In addition, the ceramic-based coating can further comprise colorants or other particulate material to impart color or texture to the surface to which it is dispensed.

Figure 7:
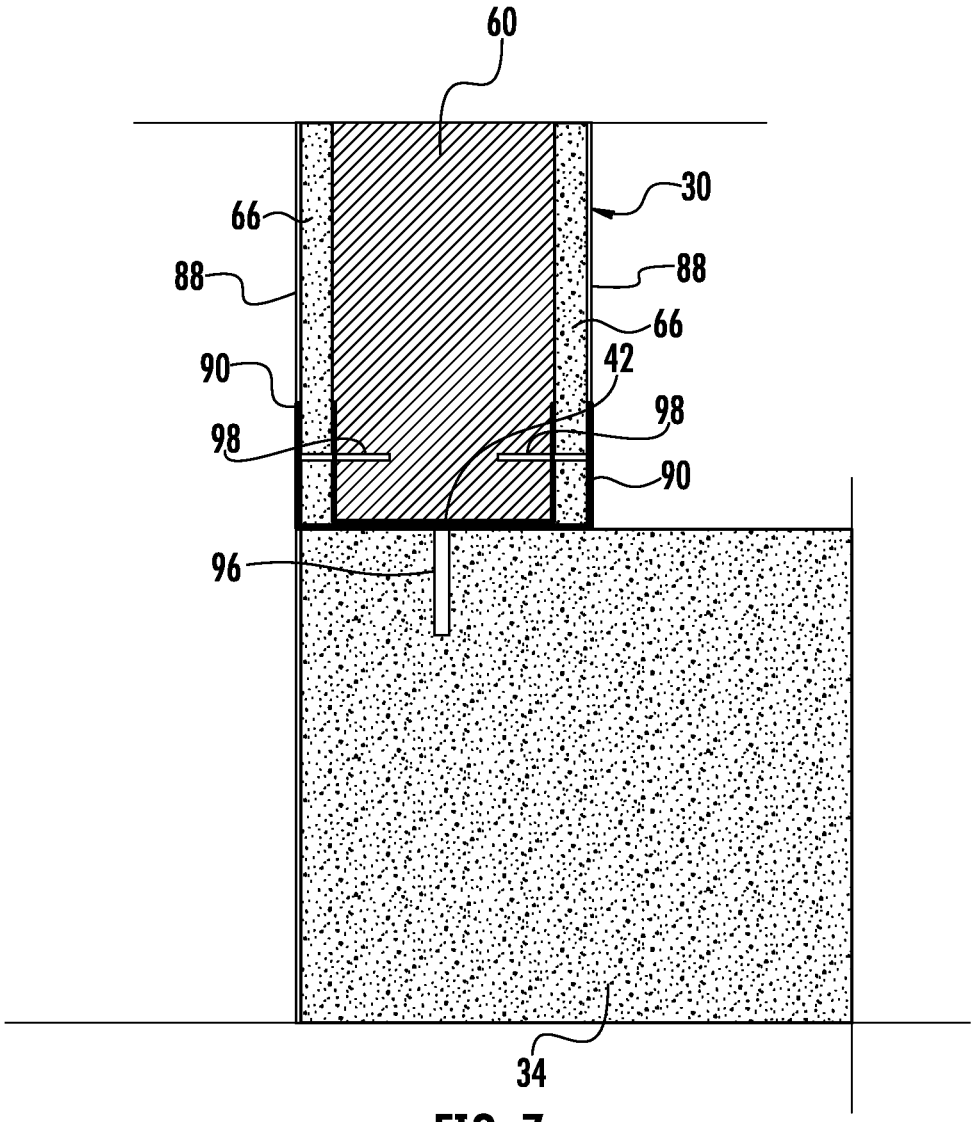
FIG. 7 is a detail view of a connection of a wall panel of FIG. 1 with a building foundation.

FIG. 7 shows the mounting of the bottom of the panel 30 to the foundation 34. A bottom channel 90 may be provided with its web on the foundation 34, and the bottom of the panel 30 may rest in the channel 90 with the channel 90 receiving the bottom track 46. The bottom channel 90 may be mounted to the foundation 34, as one example, with ½-inch diameter by 3¼-inch long Hilti Kwik Bolt 3 threaded fasteners at 3" from each end of each panel 30 at pre-drilled holes in the bottom channel 90. Likewise, the top channel 79 may be provided at the truss 36 with its flanges facing downward to receive top track 40 (FIG. 1). This connection is similar to the bottom track 42 connection to the bottom channel 90. The bottom channel 90 may be mounted to the foundation 34 with threaded mechanical expanding concrete anchors 96, or alternatively, adhesive anchors. The wall panel 30 may be attached to the channels 79, 90 with bolts or other threaded fasteners 98 of high tensile strength at 6 inches on center in pre-drilled holes in the channels 79, 90. In one embodiment the bottom channel 90 may be 18 gauge steel and the top channel may be 16 gauge steel.

The scope of the invention is not intended to be limited by materials or dimensions listed herein, but may be carried out using any materials and dimensions that allow the construction and operation of the wall panels and system. Materials and dimensions depend on the particular application.

Figure 8:
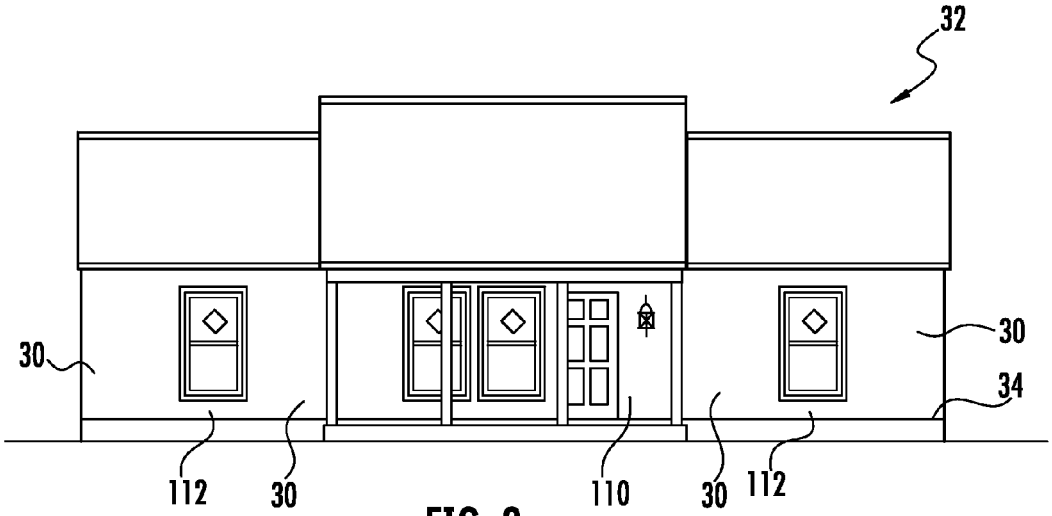
FIG. 8 is an elevation view of a building including wall panels of FIG. 1.

A completed composite panel as described herein weighs considerably less than a similarly sized reinforced "concrete" panel, and in general may have superior strength properties. Such a composite panel may weigh less than 400 pounds, making it possible for four workers, for example, to lift and place a panel without the use of a crane or other motorized lifting equipment. An embodiment as described above may weigh, for example, approximately 325 pounds. Also made possible by the reduced weight is transport of a substantial number of panels in the cargo container of a tractor-trailer that may be, in some cases, enough to complete an entire house, depending on the size of the house. An embodiment of such a house 32 is shown in FIG. 8. As shown, the house includes wall panels 30 as well as door panels 110 and window panels 112. The door panels 110 and window panels 112 may, like the wall panels 30, be composite material panels that may include metal framing, rigid insulation, and fiberglass reinforced phosphate ceramic layers, as well as incorporating a door frame or window frame, respectively. The house 32 may be shipped as a complete kit or package for assembly, including cabinets, plumbing, electrical, and appliances.

Load testing was performed on several panels made in accordance with the description provided above, at a 4 foot by 8 foot by 5 inch size including a ½-inch thick layer of phosphate ceramic on each face. The testing was performed in accordance with ASTM E72, 10 Standard Test Methods of Conducting Strength Tests of Panels for Building Construction. Testing performed included flexure, axial loading, and racking shear performance.

Figure 9:
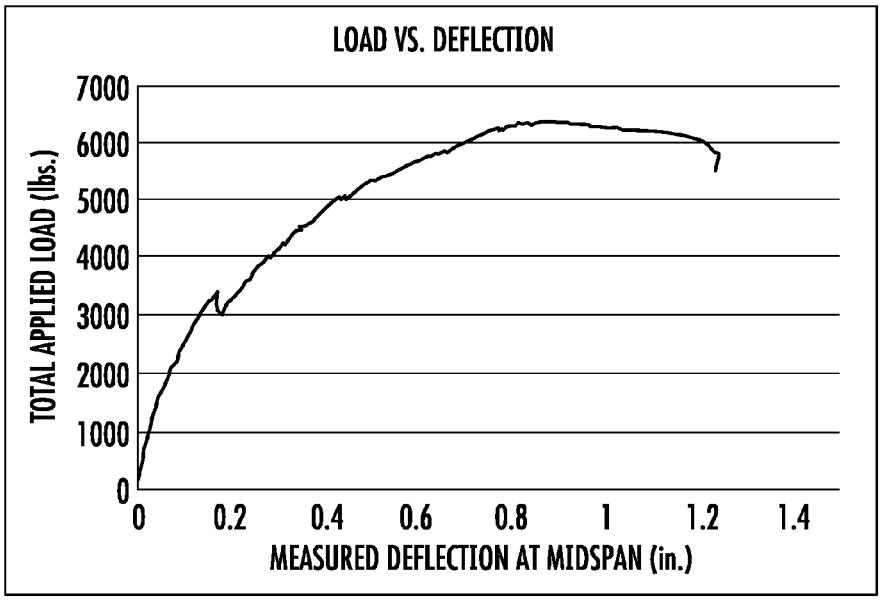
FIG. 9 is a plot of data from a flexural test of an exemplary wall panel.

The flexure test demonstrated the ability of a panel to resist a four point pressure applied to the middle section of the panel to the point at which the panel fails to hold the applied load. The flexure test was conducted with a panel in the horizontal position, supported on a 7'-6" simple span. Pin and roller supports were used. Line loads were applied across the full panel width at the panel quarter-spans, per ASTM E72. Load was applied at 0.1 inches per minute to failure. Vertical deflection at midspan was measured during the flexural test. The data are plotted versus the applied load in FIG. 9. The acceptable load for the panel to resist a wind force (hurricane) of greater than 150 miles per hour is approximately 50 pounds per square foot. The test panel failed at an applied load of 6370 pounds, which equates to a resistance of 199 pounds per square foot or 4 times the minimum acceptable load.

Figure 10:
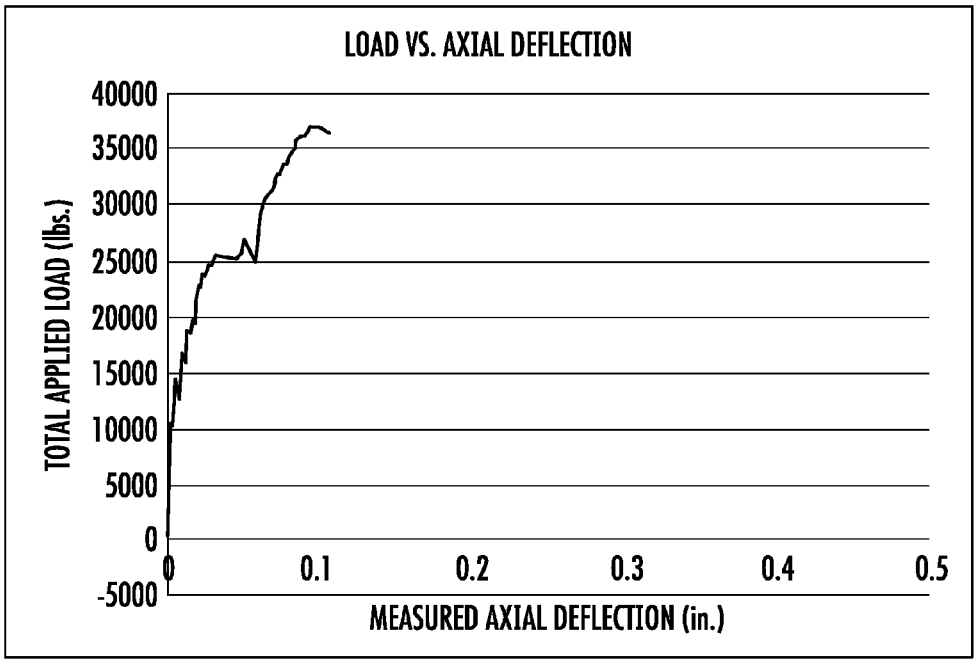
FIG. 10 is a plot of data from an axial load test of an exemplary wall panel.

An axial load test was conducted on a test panel supported in a vertical position. The panel was supported continuously along the bottom edge and loaded at three discrete points along the top edge. The three load points were each 2 inches wide and were each centered over each of the three steel stud locations within the panel. The panel vertical deflection was measured as load was applied to failure at a rate of 0.05 inches per minute, and the load versus axial deflection data are shown in FIG. 10. The normal acceptable axial load requirement for a single panel is approximately 6,000 pounds. The maximum applied load prior to failure was 37,000 pounds, which is more than 6 times the normal acceptable applied load.

Figure 11:
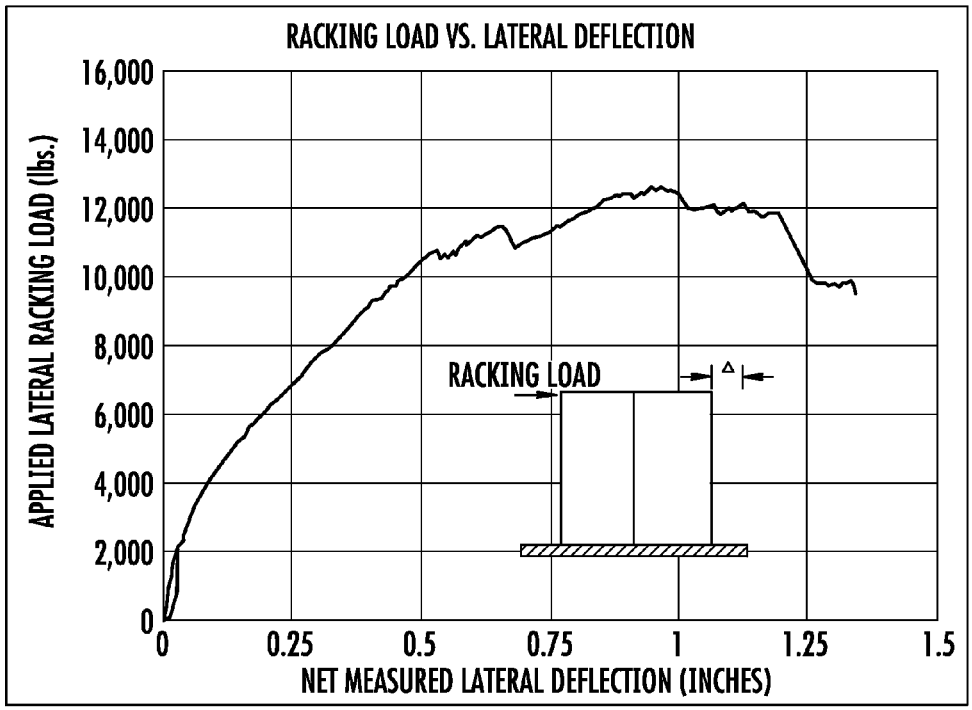
FIG. 11 is a plot of data from a racking shear test of an exemplary wall panel.

The racking test was performed using two panels connected vertically and laterally, similarly to their use in the field. The two panels were supported along their bottom edge in a steel track. The steel track was tack welded to a steel foundation at 8 inch centers, simulating connectivity that will be provided by concrete anchors in the field. Self-drilling screws (2 inches long by ¼ inch) were used to connect the track to the panel at 6 inch centers on both faces. A similar track with similar screws ran along the top edge of the panels. The panels were connected along their vertical seam at four discrete locations, two locations on each face. Each discrete connection consisted of a ¼ inch thick connection plate and four self-drilling screws. A lateral racking load was applied in the plane of the panel, per ASTM E72. Lateral deflection at the panel top corner was measured in the racking test. The data are plotted versus the applied load in FIG. 11. These data are corrected to account for minimal measured support motion. Load was applied at 0.1" per minute to failure. The normal acceptable applied force for wall panels in this test is about 2,400 pounds. The maximum applied load was 12,600 pounds of force, equivalent to 1,575 pounds per linear foot.

Accordingly, based on the results of this testing, such panels may provide extraordinary performance in a housing system that may easily sustain hurricane force winds and high seismic events.

The terminology used herein is for the purpose of describing particular embodiments only and is not intended to be limiting of the disclosure. As used herein, the singular forms "a", "an", and "the" are intended to include the plural forms as well, unless the context clearly indicates otherwise. It will be further understood that the terms "comprises" and/or "comprising," when used in this specification, specify the presence of stated features, integers, steps, operations, elements, and/ or components, but do not preclude the presence or addition of one or more other features, integers, steps, operations, elements, components, and/or groups thereof.

Although specific embodiments have been illustrated and described herein, those of ordinary skill in the art appreciate that any arrangement which is calculated to achieve the same purpose may be substituted for the specific embodiments shown and that the embodiments herein have other applications in other environments. This application is intended to cover any adaptations or variations of the present disclosure. The following claims are in no way intended to limit the scope of the disclosure to the specific embodiments described herein.

What is claimed is:

1. A panel comprising:

a central core having a first face and a second face and including:

structural framing members comprising light gauge metal assembled to form a perimeter and to define at least one opening therethrough; and a substantially rigid insulation disposed in the at least one opening of the structural framing members; and a phosphate ceramic layer positioned on each of the first face of the central core to form a first face of the panel and the second face to form a second face of the panel, wherein the insulation defines at least one passage, and phosphate ceramic extends through the passage between the phosphate ceramic layer on the first face of the central core and the phosphate ceramic layer on the second face of the central core.

2. The panel of claim 1, wherein the insulation comprises expanded polystyrene or fiberglass material.

3. The panel of claim 1, wherein the phosphate ceramic comprises magnesium phosphate.

4. The panel of claim 3, wherein the phosphate ceramic further comprises one or more of alkali silicate, alkali metal, alkali earth metal, fly ash, slag, crushed glass, and silica.

5. The panel of claim 1, further comprising a fire-resistant ceramic-based coating deposited on the phosphate ceramic on at least one of the first face of the panel and the second face of the panel.

6. The panel of claim 5, wherein the fire-resistant ceramic-based coating further comprises one or more alkali silicate, alkali metal, alkali earth metal, fly ash, slag, crushed glass, silica, and colorant.

7. The panel of claim 1, wherein the at least one passage comprises a plurality of passages, each with the phosphate ceramic extending through the passage between the phosphate ceramic layer on the first face of the central core and the phosphate ceramic on the second face of the central core.

8. The panel of claim 7, wherein the phosphate ceramic extending through the passage is inherently bonded or monolithic with the phosphate ceramic layer on the first face of the central core and/or the phosphate ceramic layer on the second face of the central core.

9. The panel of claim 1, wherein the structural framing members comprise three spaced parallel studs, each stud having a C-shaped cross section with a web, two flanges, each generally perpendicular to the web, returns on each flange, and two ends, and two parallel tracks, with the tracks being perpendicular to the studs, wherein each end of each stud is attached to a track, and wherein the structural framing members form a rectangular perimeter and two rectangular openings.

10. The panel of claim 1, wherein the axial load strength of a panel measuring 4 foot by 8 foot by 5 inches and tested in accordance with ASTM E72 is at least 30,000 pounds.

11. The panel of claim 1, wherein the axial load strength of a panel measuring 4 foot by 8 foot by 5 inches and tested in accordance with ASTM E72 is at least 37,000 pounds.

12. The panel of claim 1, wherein the panel when tested in accordance with ASTM E72 withstands a flexure pressure as of at least 150 pounds per square foot prior to failure.

13. The panel of claim 1, wherein the panel when tested in accordance with ASTM E72 withstands a flexure pressure as of at least 199 pounds per square foot prior to failure.

14. The panel of claim 1, wherein a pair of assembled panels each measuring 4 foot by 8 foot by 5 inches and tested in accordance with ASTM E72 withstands a racking shear load of at least 1,200 pounds per linear foot prior to failure.

15. The panel of claim 1, wherein a pair of assembled panels each measuring 4 foot by 8 foot by 5 inches and tested in accordance with ASTM E72 withstands a racking shear load of at least 1,575 pounds per linear foot prior to failure.

16. A panel comprising:

a central core having a first face and a second face and including:

structural framing members comprising light gauge metal assembled to form a perimeter and to define at least one opening therethrough; and a substantially rigid insulation disposed in the at least one opening of the structural framing members, wherein the insulation defines a plurality of passages that extend between the first face of the central core and the second face of the central core;

a settable cement layer positioned on each of the first face of the central core to form a first face of the panel and the second face of the central core to form a second face of the panel, and settable cement disposed in the plurality of passages to extend between the first face of the panel and the second face of the panel.

17. The panel of claim 16, wherein the settable cement of the settable cement layer and the settable cement disposed in the plurality of passages is a phosphate ceramic.

18. The panel of claim 17, wherein the insulation comprises expanded polystyrene or fiberglass material.

19. The panel of claim 16, wherein the structural framing members comprise three spaced parallel studs, each stud having a C-shaped cross section with a web, two flanges, each generally perpendicular to the web, returns on each flange, and two ends, and two parallel tracks, with the tracks being perpendicular to the studs, wherein each end of each stud is attached to a track, and wherein the structural framing members form a rectangular perimeter and two rectangular openings.

20. A building system, comprising:

a foundation;

a plurality of prefabricated panels, each panel having an upper end and a lower end and being mounted to the foundation at the lower end and to at least one other adjacent panel, the panels comprising:

a central core having a first face and a second face and including:

structural framing members comprising light gauge metal assembled to form a perimeter and to define at least one opening therethrough; and a substantially rigid insulation disposed in the at least one opening of the structural framing members; and a phosphate ceramic layer on each of the first face of the central core to form a first face of the panel and the second face to form a second face of the panel; and a roof structure mounted to the upper end of the panels, wherein the insulation defines at least one passage, and phosphate ceramic extends through the passage between the phosphate ceramic layer on the first face of the central core and the phosphate ceramic layer on the second face of the central core.

21. The building system of claim 20, wherein at a joint where adjacent panels abut, recesses in the sides of the panels form a tension rod opening, and further comprising a tension rod disposed in the tensioning rod opening and having a first end and a second end, the first end of the tension rod anchored to the foundation, and the roof structure mounted to the second end of the tension rod.

22. The building system of claim 20, wherein the structural framing members comprise three spaced parallel studs, each stud having a C-shaped cross section with a web, two flanges, each generally perpendicular to the web, returns on each flange, and two ends, and two parallel tracks, with the tracks being perpendicular to the studs, wherein each end of each stud is attached to a track, and wherein the structural framing members form a rectangular perimeter and two rectangular openings.

23. A method of making a composite panel, comprising:

assembling structural members comprising light gauge metal and rigid insulation to form a central core having a first face and a second face, wherein passages are provided through the rigid insulation;

dispensing a first layer of a settable phosphate ceramic composition in a form having the shape of the outer limits of the panel and allowing at least a portion of the first layer to at least partially set;

placing the central core in the form over the first layer of the at least partially set phosphate ceramic;

dispensing additional settable phosphate ceramic composition to fill the voids between the structural members and the form, to fill the passages, and to provide a second layer of at the least partially set phosphate ceramic on the second face of the core.

24. The method of claim 23, wherein the at least partially set phosphate ceramic comprises magnesium phosphate.

25. The method of claim 24, wherein the at least partially set phosphate ceramic further comprises one or more of alkali silicate, alkali metal, alkali earth metal, fly ash, slag, crushed glass, and silica.

26. The method of claim 23, further comprising spray coating a fire-resistant ceramic-based coating formulation on the composite panel.

27. The method of claim 23, wherein assembling structural members and rigid insulation to form a central core comprises assembling the structural framing members from members comprising three spaced parallel studs, each stud having a C-shaped cross section with a web, two flanges, each generally perpendicular to the web, returns on each flange, and two ends, and two parallel tracks, with the tracks being perpendicular to the studs, wherein each end of each stud is attached to a track, and wherein the structural framing members form a rectangular perimeter and two rectangular openings.

* * * * *